United States Patent [19]

Mizuta et al.

[11] Patent Number: 4,588,877

[45] **Date of Patent: * May 13, 1986**

[54] PUSH-BUTTON SWITCH

[75] Inventors: Ken Mizuta, Miyagi; Shiro Kondo; Michitada Akazawa, both of Furukawa, all of Japan

[73] Assignee: Alps Electric Co., Ltd., Japan

[ * ] Notice: The portion of the term of this patent subsequent to Aug. 9, 2000 has been disclaimed.

[21] Appl. No.: 300,442

[22] Filed: Sep. 8, 1981

[30] Foreign Application Priority Data

Sep. 8, 1980 [JP] Japan ..... 55-127361[U]

[51] Int. Cl.[4] ..... H01H 5/20; H01H 13/38

[52] U.S. Cl. ..... 200/67 DB; 200/16 R; 200/159 A

[58] Field of Search ..... 200/159 A, 67 DB, 67 DA, 200/340

[56] References Cited

U.S. PATENT DOCUMENTS

| | | | |
|---|---|---|---|
| 3,899,648 | 4/1975 | Murata | 200/5 R |
| 4,002,871 | 1/1977 | Sims, Jr. | 200/159 A |
| 4,002,879 | 1/1977 | Sims, Jr. | 200/159 A |
| 4,249,055 | 2/1981 | Matsuo | 200/67 DB X |
| 4,398,070 | 8/1983 | Rondo et al. | 200/67 DB X |
| 4,405,895 | 9/1983 | Kondo et al. | 200/67 DB |
| 4,426,559 | 1/1984 | Kondo et al. | 200/159 A |

FOREIGN PATENT DOCUMENTS

| | | | |
|---|---|---|---|
| 1440250 | 6/1976 | United Kingdom | 200/159 A |

*Primary Examiner*—Stephen Marcus
*Assistant Examiner*—Ernest G. Cusick
*Attorney, Agent, or Firm*—Guy W. Shoup

[57] ABSTRACT

A thin type push-button switch of momentary operation, comprising a movable contact piece which includes an inversion portion and arms formed in a manner to hold the inversion portion therebetween. The inversion portion is formed with a movable contact portion having tongues, and is integrally formed of a resilient metal sheet. A case includes a groove held in engagement with one of the arms and stationary contacts are fixed within the case. A slider includes a push-button portion and a groove held in engagement with the other arm and is slidable with respect to the case. When the push-button portion is depressed, the inversion portion of the movable contact piece is inverted to electrically connect the movable contact portion and the stationary contacts. When the depressing force is released, the inversion portion is restored by the resiliency of the movable contact piece, to disconnect the movable contact portion and the stationary contacts.

6 Claims, 6 Drawing Figures

PUSH-BUTTON SWITCH

BACKGROUND OF THE INVENTION

The present invention relates to a push-button switch. More particularly, it relates to a push-button switch of momentary operation which has a light touch for actuation and requires reduced space.

As momentary switches, various structures have heretofore been proposed and put into practical use. A well-known momentary switch is as shown in FIG. 1. A movable contact piece 11 is constructed by forming a highly-resilient electrically-conductive metal sheet into the shape of a bowl. A contact portion 11*a* of the movable contact piece 11 and respective contact portions 12*a* and 13*a* of stationary contact pieces 12 and 13 are arranged in a case 14 in a manner opposed to each other. By depressing a push button 15, the movable contact piece 11 is inverted to bring the contact portion 11*a* of the movable contact piece 11 and the stationary contact portions 12*a* and 13*a* into touch with each other. Thus, a switching circuit is turned "on". Upon releasing the depression of the push button 15, the spring force of the movable contact piece 11 acts to return the push button 15 and the contact portion 11*a* to their initial positions. Then, the switching circuit is turned "off".

Such prior-art momentary switches have the structure in which substantially the central part of the movable contact piece 11 is depressed in the height direction thereof. Therefore, the space required for the switch is liable to become large, which forms an obstacle to the miniaturization of equipment containing the switch. This disadvantage appears more conspicuously as the number of switches to be used increases.

The structure of the prior-art momentary switch in which the movable contact piece is depressed in the height direction thereof is also disadvantageous in that the inverting operation of the movable contact piece is not transmitted to the finger, so the feel of change-over is feeble.

SUMMARY OF THE INVENTION

An object of the present invention is to provide a push-button switch which has reduced height, has a light touch of operation and has a high reliability.

According to one aspect of performance of the present invention, there is provided a push-button switch comprising an inversive spring movable contact piece which includes an inversion portion and arms formed in a manner to hold said inversion portion therebetween. The inversion portion and the arms are integrally formed of a highly-resilient electrically-conductive metal sheet, and the inversion portion is substantially centrally formed with a movable contact portion having tongues. A case which includes an engaing portion held in engagement with one of the arms and stationary contacts are fixed within said case. A a slider which includes a push-button portion and an engaging portion held in engagement with the other arm of the movable contact piece is installed in a manner to be movable with respect to the case. The movable contact portion is held in opposition to the stationary contacts with the inversion portion of the inversive spring movable contact piece being inverted by depressing the push-button portion, thereby to establish electrical contact between the movable contact portion and the stationary contacts.

PREFERRED EMBODIMENT OF THE INVENTION

Figure 1:
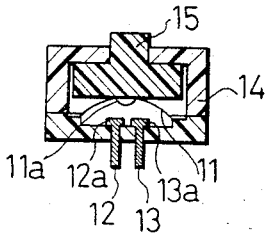
Fig.1 PRIOR ART
FIG. 1 is a sectional view of a prior-art push-button switch.
Figure 3:
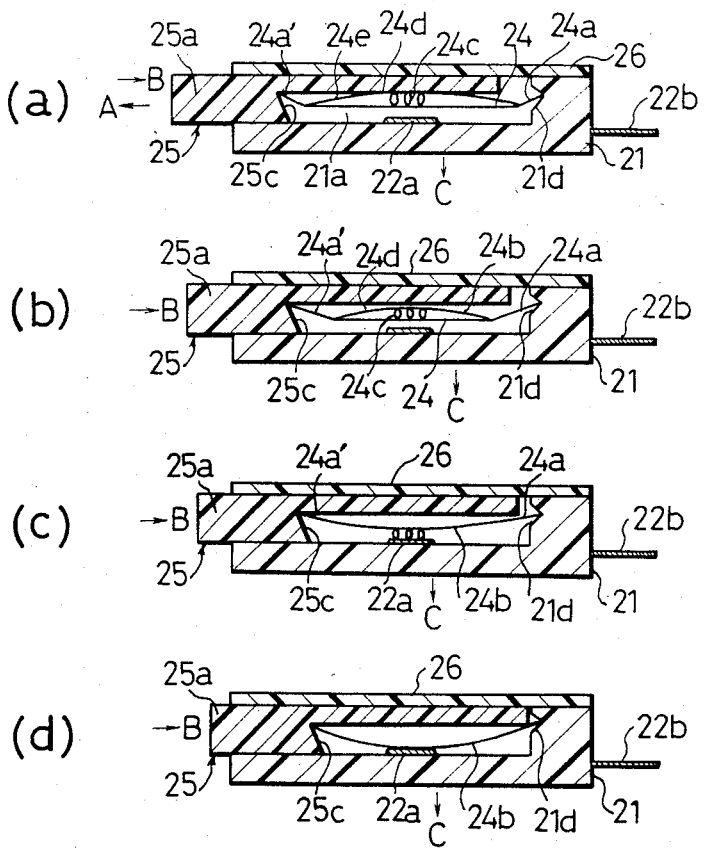
FIGS. 3(a) to 3(d) are sectional views for explaining the operation of the push-button switch according to the present invention.
Figure 2:
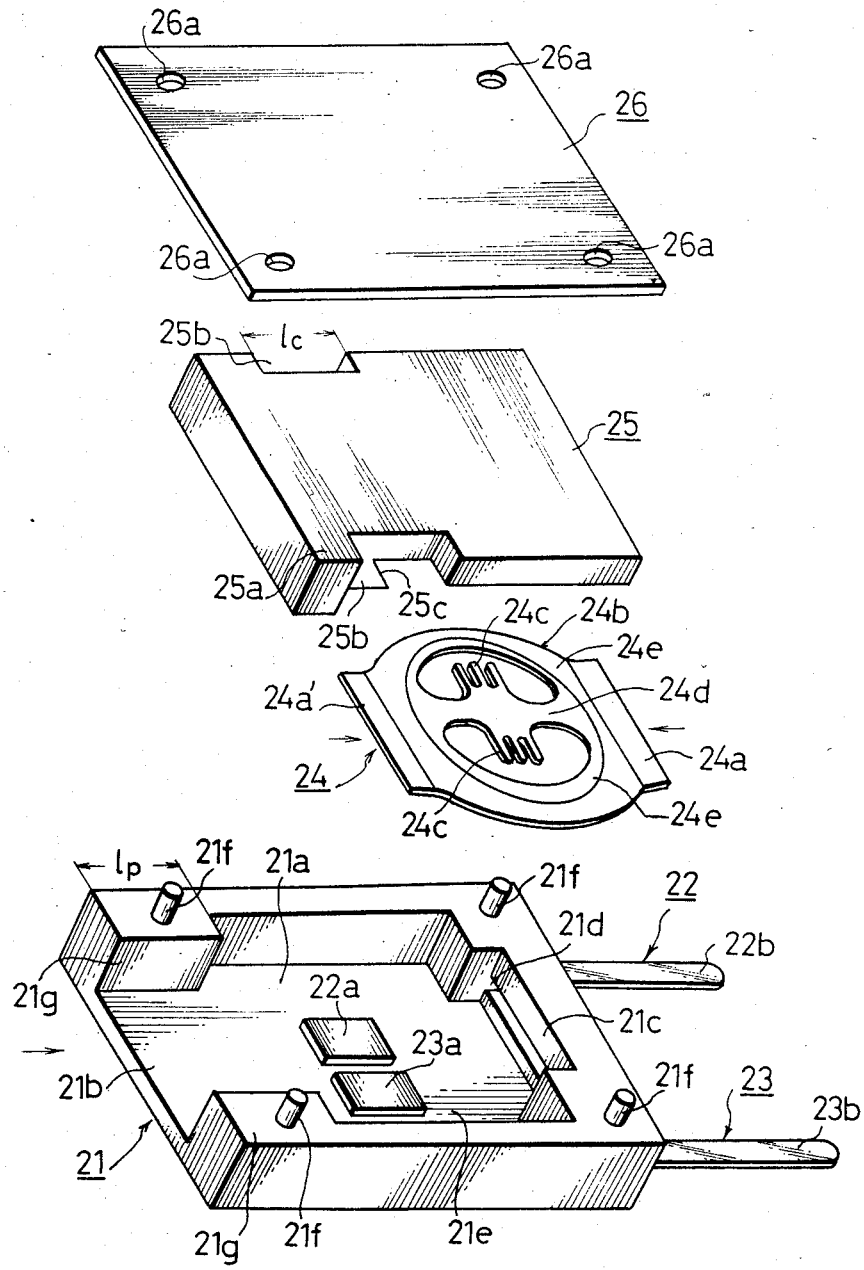
FIG. 2 is an exploded perspective view of a push-button switch according to the present invention.

Hereunder, an embodiment of the present invention will be described in detail with reference to FIGS. 2 and 3(*a*)–3(*d*).

In the figures, numeral 21 designates a case which is fabricated by insert-molding a synthetic resin. It has a recess 21*a* in which a slider to be described later is slidable, an opening 21*b*, a groove 21*d* which is formed into a V-shaped section in a side wall 21*c* opposite to the opening, a bottom 21*e* to which stationary contacts having exposed portions 22*a* and 23*a*, respective stanchions 21*f* formed at each of the four corners to mount a cover to be described later, and protuberances 21*g* and 21*g* extending inwardly of the recess 21*a*. Stationary contact pieces 22 and 23 have their stationary contact portions 22*a* and 23*a* exposed on the surface of the bottom 21*e* of the case 21 and lead to external connection terminals 22*b* and 23*b*, respectively. The stationary contact pieces 22 and 23 are fixed to the case simultaneously with the molding of the case by arranging them in a metal mold and insert-molding the synthetic resin.

Numeral 24 designates a movable contact piece which is integrally formed of a highly-resilient electrically-conductive metal sheet. It has a pair of arms 24*a* and 24*a*' which are formed at respective end portions, and an inversion portion 24*b* which is formed in a manner to be held between the arms. The inversion portion 24*b* is partly punched to form a movable contact portion 24*d* and coupling portions 24*e* and 24*e*. The movable contact portion 24*d* has tongues 24*c* and 24*c* each of which is formed into the shape of the letter E and is somewhat bent downwards. The inversion portion 24*b* can be inverted and protruded downwards by applying forces in the sense of the illustrated arrows to the arms 24*a* and 24*a*'. In order to promote the inversion action, each of the arms 24*a* and 24*a*' is subjected to bending so that its base part may be folded back at a certain angle.

The slider 25 referred to above has a push-button portion 25*a*, cuts 25*b* and 25*b* which engage the protuberances 21*g* and 21*g* disposed in the case 21, and a flange portion 25*c*. The length $l_c$ of the cuts 25*b* and 25*b* is made greater than the length $l_p$ of the protuberances 21*g* and 21*g*, whereby the slider 25 is movable $(l_c - l_p)$ in the recess 21*a* of the case 21. One arm 24*a*' of the movable contact piece 24 engages the flange portion 25*c*. The cover 26 referred to above closes the case 21 from above, and is formed in its four corners with holes 26*a* into which the stanchions 21*f* of the case 21 are inserted. The cover 26 can be fastened to the case 21 in such a way that the top surface of the case 21 is coated with a binder in advance and that the cover 26 is placed on the case 21 with the stanchions 21*f* inserted in the corresponding holes 26*a*.

Now, the assemblage of the push-button switch according to the present invention will be described.

First, the case 21 is formed by the insert-molding, and the stationary contact pieces 22 and 23 are simultaneously secured unitarily with the case 21.

Subsequently, one arm 24*a* of the movable contact piece 24 is assembled in engagement with the groove 21*d* formed in the case 21.

Thereafter, the slider 25 is arranged in the opening 21*b* of the recess 21*a* of the case 21, and the other arm 24*a'* of the movable contact piece 24 is brought into engagement with the flange portion 25*c* of the slider 25. Under this state, the slider 25 is somewhat thrust in the direction of depression of the movable contact piece 24 so as to bring the cuts 25*b* and 25*b* into engagement with the protuberances 21*g* and 21*g* of the case 21. Thus, the central part of the movable contact portion 24*d* formed into the E-shape comes into close contact with the rear surface of the slider 25. The slider 25 is normally urged outwards by the spring force of the movable contact piece 24, and the push-button portion 25*a* projects out of the case 21.

Lastly, the cover 26 is placed on the top surface of the case 21 with the stanchions 21*f* of the latter inserted through the holes 26*a* of the former and is fixed with a binder. Then, the push-button switch according to the present invention is finished up (FIG. 3(a)).

Now, the operation of the push-button switch according to the present invention will be described with reference to FIGS. 3(a)–3(d).

Under the undepressed state of the push-button portion 25*a* (FIG. 3(a)), the arms 24*a* and 24*a'* of the movable contact piece 24 are respectively held in engagement with the groove 21*d* of the case 21 and the flange portion 25*c* of the slider 25, and hence, the slider 25 is urged outwards (in the direction of arrow A). Therefore, the slider 25 assumes its leftmost position, and the movable contact portion 24*d* is not in contact with the stationary contact portions 22*a* and 23*a* of the respective stationary contact pieces 22 and 23 (switch "off").

When, under this state, the push-button portion 25*a* is depressed in the direction of the arrow B, the arms 24*a* and 24*a'* of the movable contact piece 24 curve in the direction of arrow C (FIG. 3(b)).

When the push-button portion 25*a* is further depressed in the direction of arrow B, the coupling portions 24*e*, 24*e* and movable contact portion 24*d* of the movable contact piece 24 are instantly inverted in the direction of arrow C. At this time, the tongues 24*c* and 24*c* of the movable contact portion 24*d* are brought into pressed contact with the corresponding stationary contact portions 22*a* and 23*a* by the repulsive force of the movable contact piece 24, and the switch falls into the "on" state (FIG. 3(c)).

When, under this state, the push-button portion 25*a* is further depressed, the slider 25 slides as illustrated in FIG. 3(d) while the tongues 24*c* and 24*c* of the movable contact portion 24*d* are being deformed in pressed contact with the stationary contact portions 22*a* and 23*a* until their resilient limit is reached. The movable range of the slider 25 can be adjusted by changing the length $l_c$ of the cuts 25*b*, 25*b* and the length $l_p$ of the protuberances 21*g*, 21*g*.

When the depressing force is released from the depressed state of the push-button portion 25*a*, the switch is reset into the state of FIG. 3(a) in the reverse order of the foregoing stages and turns "off".

As set forth above, according to the present invention, the inversion portion 24*b* is provided by forming the highly-resilient electrically-conductive metal sheet into the bulge-or inverted V-shape, the inversion portion is formed substantially centrally with the movable contact portion 24*d* having the tongues 24*c* and is provided with the arms 24*a* and 24*a'* at respective an ends so as to form an inversive spring movable contact piece, the movable contact portion 24*d* is arranged within the case 21 in opposition to the stationary contact portions 22*a* and 23*a*, and by depressing and operating the tongues 24*c* in the lengthwise direction of the movable contact piece 24, the inversion portion 24*b* is inverted perpendicularly to the direction of depression, thereby to turn "on" the switch. Therefore, the height of the push-button switch can be made very small. Further, since the inversive action is transmitted to the finger, the feel of operation is very excellent. In addition, since the tongues 24*c* are formed and their movements can achieve a satisfactory cleaning effect on the stationary contact portions, a stable contact can be held. Thus, the present invention can provide the thin type push-button switch having the contact structure of high reliability.

What is claimed is:

1. A push-button switch comprising an inversive spring movable contact piece including an inversive portion and arms formed in a manner to hold said inversive portion therebetween, said inversive portion and said arms being integrally formed of a highly-resilient electrically-conductive metal sheet, said inversive portion being substantially centrally formed with a movable contact portion having tongues; a case including an engaging portion held in engagement with one of said arms; stationary contacts fixed within said case; and a slider including a push-button portion and an engaging portion held in engagement with the other arm and installed in a manner to be movable with respect to said case; said movable contact portion being held across from said stationary contacts, said inversive portion of said inversive spring movable contact piece being inverted by depressing said push-button portion, thereby to establish electrical contact between said movable contact portion and said stationary contacts.

2. A push-button switch according to claim 1, wherein said tongues are formed on respective sides of said movable contact portion.

3. A push-button switch according to claim 2, wherein said each tongue is formed of a plurality of metal strips.

4. A push-button switch according to claim 1, wherein said engaging portion of said case and said engaging portion of said slider are V-shaped grooves.

5. A push-button switch including a case having a wall portion containing a plurality of fixed contacts; a slider adapted to be moved inwardly of said casing; a movable contact having a central contact portion extending away from said fixed contacts, a first arm portion adapted to be held by said case, a second arm portion located oppositely from said first arm portion and adapted to be held by said slider, and means including connecting portions extending between said arm portions and said central portion for holding said central portion in position while permitting it to rapidly invert during inward movement of said slider to bring said central portion into engagement with said fixed contacts.

6. A push-button switch according to claim 5, said central portion including a plurality of tongues extending towards said fixed contacts.

* * * * *